United States Patent [19]

Straitz, III

[11] 4,070,146

[45] Jan. 24, 1978

[54] FLARE BURNER FOR WASTE COMBUSTIBLE GAS

[75] Inventor: John F. Straitz, III, Jenkintown, Pa.

[73] Assignee: Combustion Unlimited Incorporated, Elkins Park, Pa.

[21] Appl. No.: 559,492

[22] Filed: Mar. 18, 1975

[51] Int. Cl.[2] ..... F23D 13/20

[52] U.S. Cl. ..... 431/202; 23/277 C; 431/114; 239/518; 239/521; 239/568

[58] Field of Search ..... 431/4, 114, 202, 278, 431/284, 285; 23/277 C; 110/1 A

[56] References Cited

U.S. PATENT DOCUMENTS

| | | | |
|---|---|---|---|
| Re. 27,507 | 10/1972 | Turpin | 23/277 C |
| 1,626,000 | 4/1927 | Kay | 110/1 A |
| 2,429,949 | 10/1947 | Thayer | 110/1 A |
| 2,971,605 | 2/1961 | Frost et al. | 23/277 C |
| 3,162,236 | 12/1964 | Williams | 431/202 |
| 3,236,279 | 2/1966 | Beyer | 431/284 |
| 3,703,349 | 11/1972 | Straitz | 431/202 |
| 3,748,085 | 7/1973 | Poepsel et al. | 431/114 |
| 3,749,546 | 7/1973 | Reed et al. | 431/202 |
| 3,832,815 | 9/1974 | Balaz et al. | 110/1 A |
| 3,836,318 | 9/1974 | Desty et al. | 431/202 |
| 3,859,033 | 1/1975 | Buchanan et al. | 431/202 |
| 3,933,420 | 1/1976 | Zihk et al. | 431/202 |

*Primary Examiner*—Carroll B. Dority, Jr.
*Attorney, Agent, or Firm*—Zachary T. Wobensmith, 2nd; Zachary T. Wobensmith, III

[57] ABSTRACT

A flare burner of the ground flare type for incinerating waste combustible gas from refineries and the like is disclosed, for use in populated areas, which has a plurality of waste gas burner heads for simultaneous operation at the same level, which may be utilized as a ground flare or which may, in a modified form, be elevated and provided with a bottom heat shield, which can have additional combustible liquid waste burners in one or more side walls, the flare burner having a combustion chamber with an improved panel construction and a fence of the knock out type to minimize wind effects and to provide an acoustical barrier so that noise transmission horizontally from the lower air inlets is greatly reduced.

16 Claims, 23 Drawing Figures

Fig. 3.
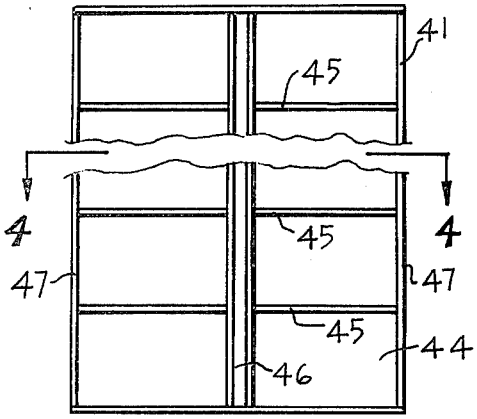
Fig. 2.
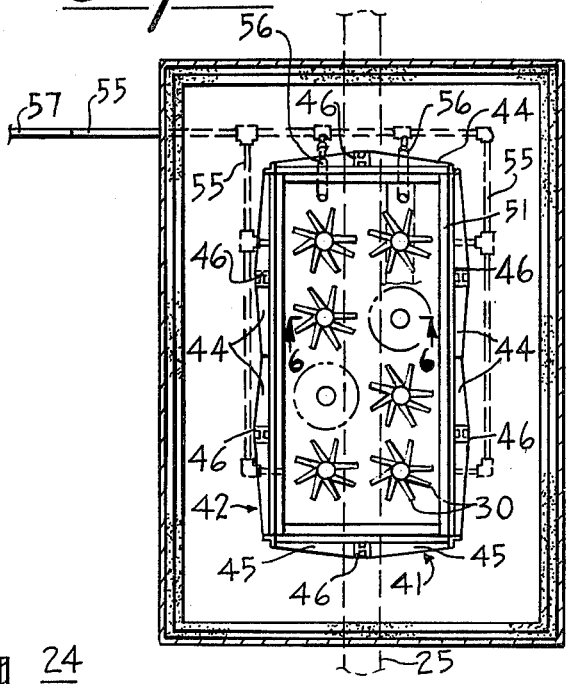
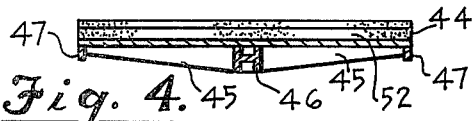
Fig. 4.
Fig. 1.
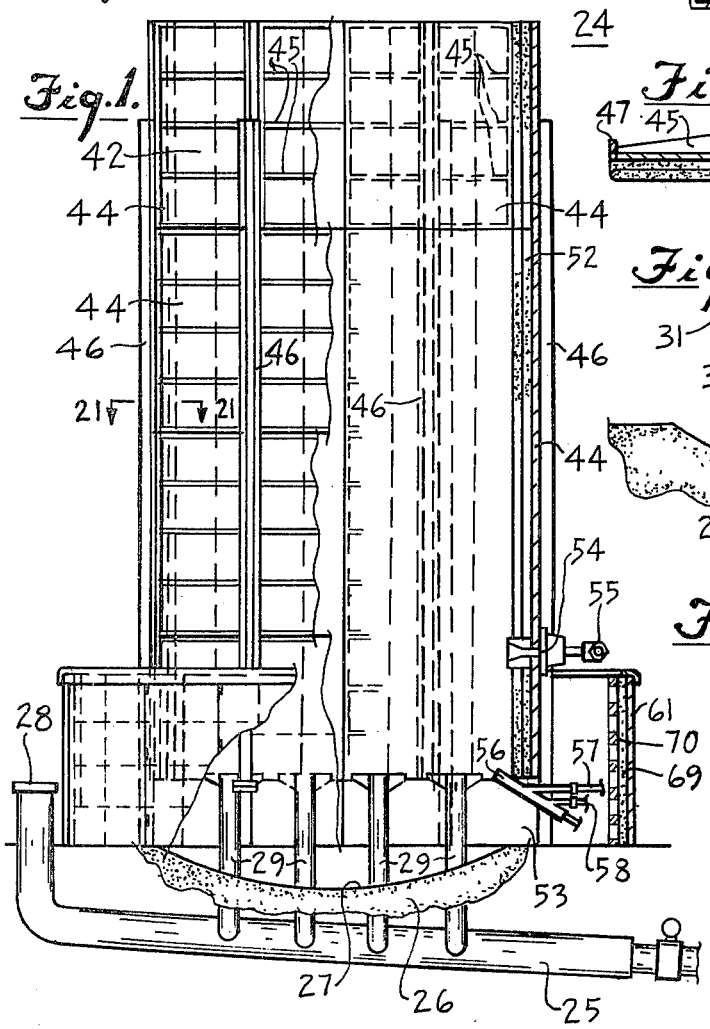
Fig. 5.
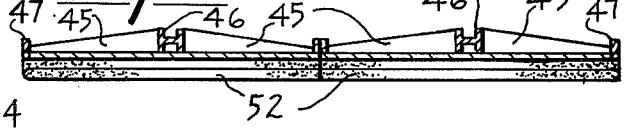
Fig. 6.
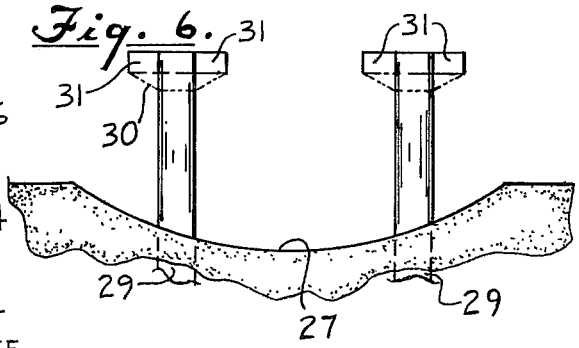
Fig. 7.
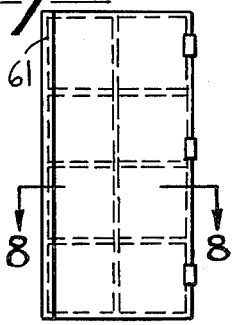
Fig. 8
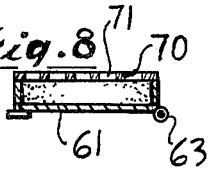

Fig. 10.
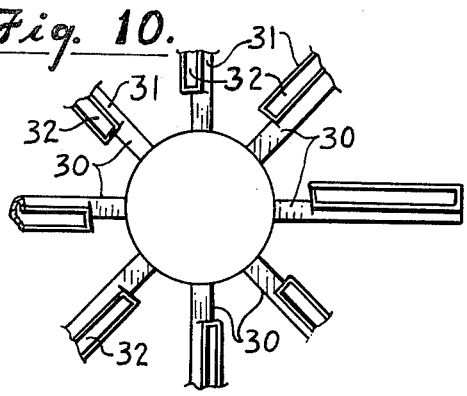
Fig. 14.
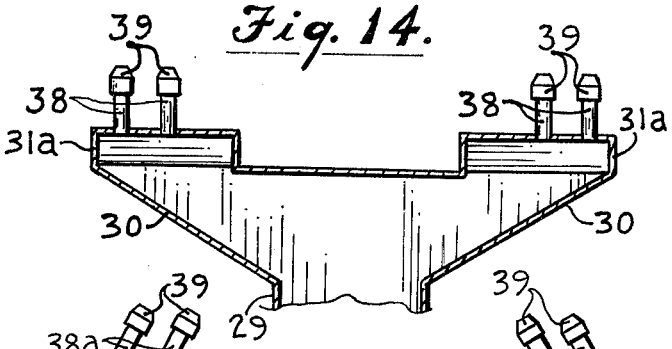
Fig. 15.
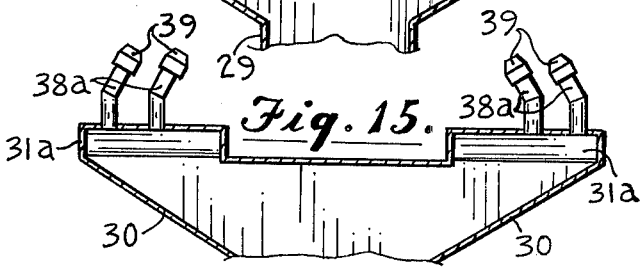
Fig. 9.
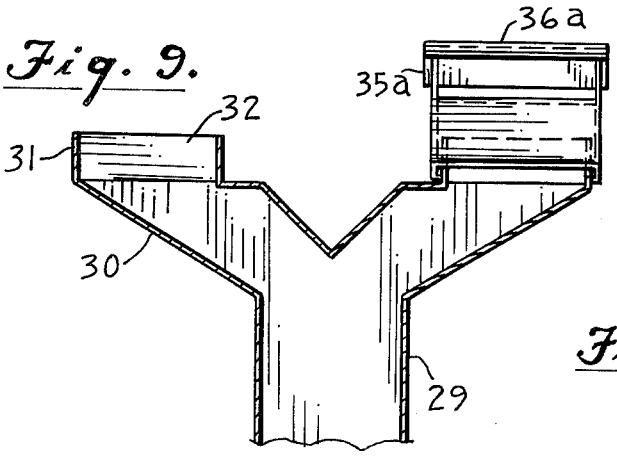
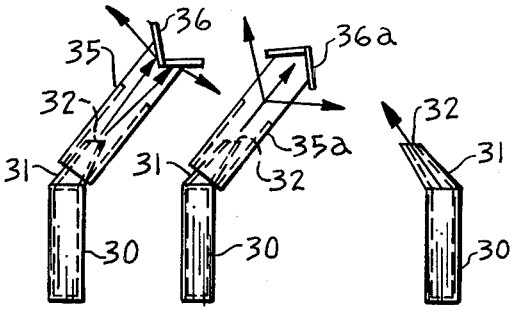
Fig. 12. Fig 13. Fig 11
Fig. 21.
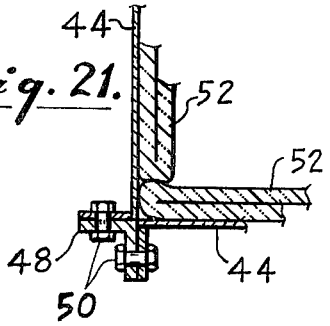
Fig. 22.
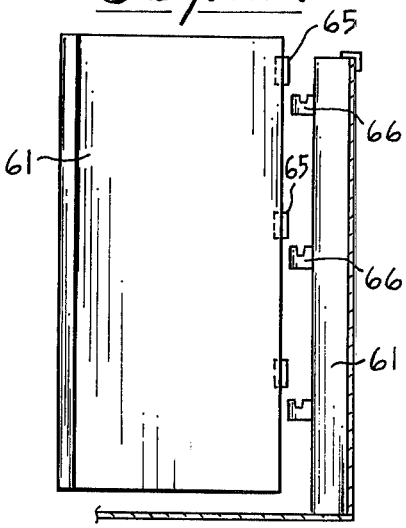

FLARE BURNER FOR WASTE COMBUSTIBLE GAS

BACKGROUND OF THE INVENTION

1. Field of the Invention

This invention relates to flare burners and more specifically to apparatus for the combustion of combustible waste gas from refineries and the like.

2. Description of the Prior Art

It is common practice to burn waste gas from refineries and the like. A commonly used structure for this purpose comprised a central gas pipe of a diameter in the range from 24 to 30 inches, surrounded by a large insulated cylinder of the order of 30 feet in diameter and from 15 to 50 feet in height. The major objection to this design is that the gas being burned is concentrated in one central area with inadequate surface area for mixing air for combustion with the gas. The diffusion of the gas and air has a great effect upon the surface area of the flame and this was not taken into account with many of the structures of that type. Diffusion is also dependent upon the Reynolds number, that is whether it is a laminar or turbulent type of mixing.

While the combustion can and has been improved using stacks of that type they are expensive and difficult to erect and may have maintenance problems aggravated by the necessity for repairs at the top of the stack.

It has also been proposed to provide a multi-jet ground flare in which a series of smaller gas delivery pipes, of about 2 inch diameter on 6 inch centers, connected to one or more manifolds and enclosed within an insulated cylindrical enclosure carried on supporting legs, with flame retention rods above the upper end of each of the gas delivery pipes. With this structure, serious mechanical problems arise because of thermal expansion. The stainless steel gas manifold that feeds the smaller gas nozzle is adversely effected by radiation on the top of the manifold which passes through the insulation, and it tends to heat up the top of the pipe. The lower section of the manifold has no thermal radiation from it so that differential expansion occurs and the manifold tends to bow. The use of insulation on the manifold has not proven to be effective.

The flame retention rods referred to above are usually of a length of 30 to 40 feet. These rods have a very short life because of their tendency to burn up and involve difficulties as to their mounting and support and their tendency to bow because of thermal expansion.

Frank, U.S. Pat. No. 1,807,977 and Frost, et al., U.S. Pat. No. 2,971,605 show a plurality of burners.

It is preferred where feasible and is essential under certain conditions to employ a flare in which a plurality of waste gas burners at the same level are employed.

In my prior U.S. Pat. No. 3,703,349, a ground flare is disclosed for incinerating waste combustible gas. The structure there disclosed while satisfactory for some purposes, has shortcomings, including limitations as to location, susceptibility of damage by rain, relatively high weight of the assembled enclosure, and undesirable noise transmission to the surrounding area.

In accordance with the present invention a flare burner of the ground flare type is provided which has a plurality of waste gas burners for simultaneous operation, which may be utilized as a ground flare or which may in a modified form be elevated and provided with a heat shield for use on the top of a building or on board a ship, which can optionally be provided with additional combustible liquid waste burners, in one or more of the side walls, of the combustion chamber, which has a combustion chamber with wall panels and which has provisions to reduce the horizontal noise transmission.

It is the principal object of the invention to provide an improved flare burner for waste combustible gas which is of simplified construction, which is light in weight, which operates at a lower outside skin temperature, which is better adapted for operation under rainy conditions, which heats quickly and cools quickly, which has fewer problems of expansion and contraction and which greatly reduces noise transmission.

It is a further object of the invention to provide a flare burner which operates at a low level and does not project flame into the air to great heights as with many of the flare stack burners now in use.

It is a further object of the invention to provide a flare burner which has a wide range of adaptability and usefulness for the incineration of combustible refinery wastes.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part thereof, in which:

FIG. 1 is a view in elevation and as seen from one side of a preferred form of flare burner and its associated components in accordance with the invention, for use on the ground, parts being broken away to show the details of construction;

FIG. 2 is a top plan view of the flare burner shown in FIG. 1;

FIG. 3 is a fragmentary view in elevation, on a larger scale than FIGS. 1 and 2 showing details of the end wall construction;

FIG. 4 is a horizontal sectional view on the line 4—4 of FIG. 3;

FIG. 5 is a view similar to FIG. 4 but related to the side wall;

FIG. 6 is a fragmentary transverse vertical sectional view taken approximately on the line 6—6 of FIG. 2;

FIG. 7 is an elevational view of a portion of the acoustical fence;

FIG. 8 is a horizontal sectional view taken approximately on the line 8—8 of FIG. 7;

FIG. 9 is an enlarged vertical central sectional view of one preferred form of burner head employed in connection with the invention;

FIG. 10 is a fragmentary plan view of the burner head of FIG. 9;

FIG. 11 is a side elevational view of a combustible gas directing tip which is employed with the burner head of FIGS. 9 and 10;

FIGS. 12 and 13 are side elevational views of attachments for use with the burner tip of FIGS. 9 and 11;

FIG. 14 is a view similar to FIG. 9 showing a modified form of burner head;

FIG. 15 is a view similar to FIG. 9 showing another modified form of burner head;

FIG. 21 is a fragmentary sectional view taken approximately on the line 21—21 of FIG. 1;

FIG. 22 is a fragmentary view partly in elevation and partly in vertical section showing details of the corner of the acoustical fence.

Figure 18:
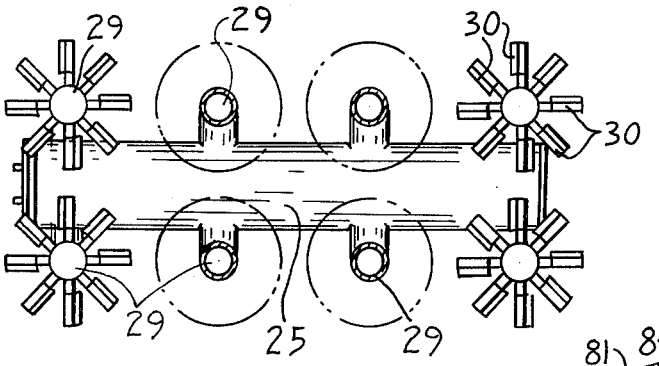
FIG. 18 is a fragmentary sectional view taken approximately on the line 18—18 of FIG. 16 showing details of the gas supply tube and burner vanes and tips.

It should, of course, be understood that the description and drawings herein are illustrative merely and that various modifications and changes can be made in the structure without departing from the spirit of the invention.

Like numerals refer to like parts throughout the several views.

DESCRIPTION OF THE PREFERRED EMBODIMENT

Referring now more particularly to the drawings, a flare burner is shown generally at 24, and a combustible waste gas supply pipe 25 is provided which in the form of the invention illustrated in FIGS. 1 and 2 is buried beneath the ground a distance of the order of 1 or 2 feet for protection against the heat released by the combustion. While the soil can be that available at the place of installation it is preferred to use above and below the supply pipe, as at 26, coarse gravel with a particle size of one half to one inch, which retains air voids and prevents packing down. The upper surface, as at 27, is preferably concave for noise reflection as hereinafter explained. The pipe 25 may extend above ground and be capped as at 28.

The pipe 25, at spaced locations therealong, has connected thereto spaced pairs of vertically extending gas delivery pipes 29. The pipes 29, at their upper ends have outwardly extending hollow horizontal vanes 30, tangentially as shown in FIGS. 1 and 2, or radially as shown in FIGS. 1, 9, 10, 14, 15, 16, 18, 19 and 20.

The vanes 30, as illustrated in FIGS. 10 and 11, have tilted converging tips 31 with upper slots 32 for discharge of gas in a vortex pattern for admixture with air for combustion.

In FIG. 9, the tip at the right is shown as having an attachment 35 thereon for changing the flame pattern. FIG. 12 illustrates the use of an angle 36 spaced outwardly from and with its vertex inwardly for dividing in sidewise directions gas discharged from the slot 32.

In FIG. 13, the attachment 35*a* has an angle 36*a* with its vertex disposed outwardly for dividing, in diverging directions, the gas discharged from the slot 32.

In FIG. 14 the vanes 30 are shown as having their tips 31*a* closed at their outer ends and provided with a plurality of pipes 38 extending upwardly therefrom with discharge nozzles 39 for gas discharge. The nozzle 39 can be of any suitable type but nozzles as disclosed in U.S. Pat. No. 3,463,602 to Bitterlich, and in which the gas is discharged through ports inclined with respect to the longitudinal axis and at an angle to horizontal radii through the burner nozzle are suitable.

In FIG. 15 the vanes 30 are shown as having their tips 31*a* closed as in FIG. 14 with angular pipes 38*a* further angularly disposed to provide a vortex pattern for the gas discharged from the nozzles 39.

Referring now more particularly to FIGS. 1, 2, 3 and 4, the vanes 30 are shown as disposed within a combustion chamber 40, which is open at the top, and is enclosed within a plurality of vertical end walls 41 and side walls 42.

The end walls 41 are each composed of a plurality of horizontally extending upright panels 44 having spaced horizontal ribs 45 engaged with upright H beams 46 forming part of the supporting frame. The panels 44 have vertical end flanges 47.

The side walls 42 are similar to the end walls 41 except for the provision of a plurality of H-beams 46 to provide the desired horizontal dimension. The side walls have upright panels 44 with ribs 45.

The vertical end flanges 47 of the panels 44 of the end walls 41 and of the side walls 42 are secured to vertical angles 48 by bolts 50 while the vertical flanges of the panels 44 of the side walls 42 are held in assembled relation by bolts (not shown) extending therethrough.

It has heretofore been customary to provide molded ceramic tile refractory or fire brick linings for combustion chambers but this results in a very heavy construction. Such linings have numerous disadvantages in use.

It is preferred to employ a stable high temperature alumina-silica ceramic fiber in blanket form which is now available.

The fiber lining 52 (see FIGS. 4 and 21) is secured to the inner faces of the panels 44 by pigtail studs or the like (not shown). The fiber blanket lining 52 for a panel 44 of a thickness of about four inches and of a density of about 8 pounds per cubic foot is suitable, is light in weight so that the framing and overall weight of the unit is reduced, so that the unit can be mounted on the roof of a building or on a ship, the skin temperature is lower, the wall heats quickly and cools quickly over wide variations in operating temperatures, problems of expansion and contraction are minimized, the reduced mass requires less time for heating with reduced conduction loss through the walls so that the combustion zone can be kept hotter and more efficient. A combustion chamber wall constructed in this matter also has a good sound absorption coefficient in a frequency range from 1000 to 16,000 cycles per second.

The panels 44 of the walls 41 and 42 are terminated in spaced relation to the ground to provide air inlet openings 53 for induction of air for combustion.

The walls 41 and 42 can, if desired, be provided with burners 54 for delivery into the combustion chamber 40 of waste liquid combustible materials delivered through supply pipe 55.

A pilot 56 is provided having a gas supply pipe 57 connected thereto and an igniter pipe 58 for supplying a flame if required to light the pilot 56.

An acoustical fence 60 is provided comprising a plurality of vertical panels 61 connected at their vertical meeting margins by readily separable connections 62 of magnets or spring type to permit of quick separation by pressure thereagainst by the operator. If desired, intermediate panels 61, as illustrated in FIGS. 7 and 8, can be carried on vertical hinge pins 63 to permit outward swinging.

The panels 61, at the corners, can be supported by lugs 65 engaging in hooked hangers 66 on an adjoining panel. The panels 61 for a height of air inlet opening 53 of about 3 feet have a height of about 7 feet.

Figure 23:
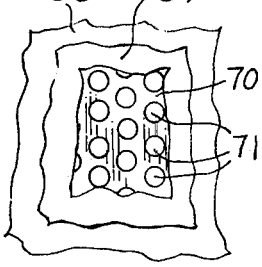
FIG. 23 is a fragmentary view in elevation illustrating the cross sectional construction of the acoustical fence.

The panels 61 preferably are of laminated construction as illustrated in FIG. 23 with an edge flanged back up sheet 68 of metal to provide adequate strength and having in engagement therewith a glass fiber blanket 69 of a thickness of the order of 4 inches and a density of the order of 4 pounds per cubic foot. The blanket is held in place by a cover sheet 70 of perforated steel plate secured with one quarter inch hole 71 therethrough on three eighth inch centers, to provide an open area of blanket 60 of the order 42%.

The structure previously described is suitable for use as a ground flare and with minor modifications is suitable for a flare burner to be mounted on the top of a building or on the deck of a ship.

Figure 17:
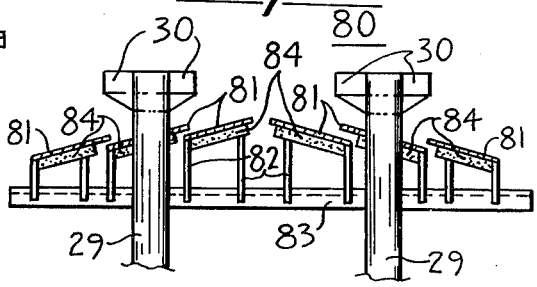
FIG. 17 is a transverse sectional interior view of the burner shown in FIG. 16 illustrating a preferred form of floor construction.
Figure 19:
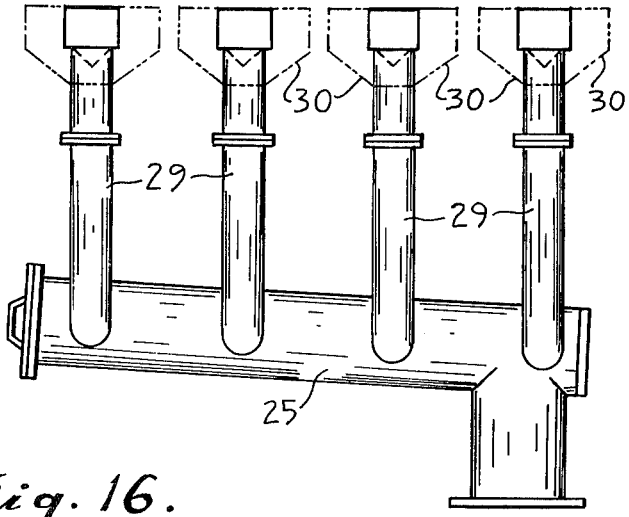
FIG. 19 is a side elevational view of the burners and the combustible gas supply piping.
Figure 20:
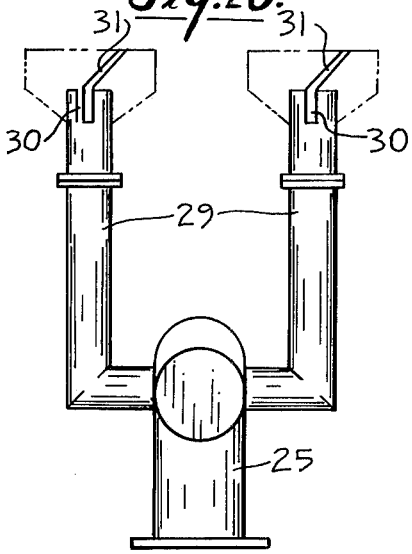
FIG. 20 is an end elevational view of the structure shown in FIG. 19 as seen from the right of FIG. 19.
Figure 16:
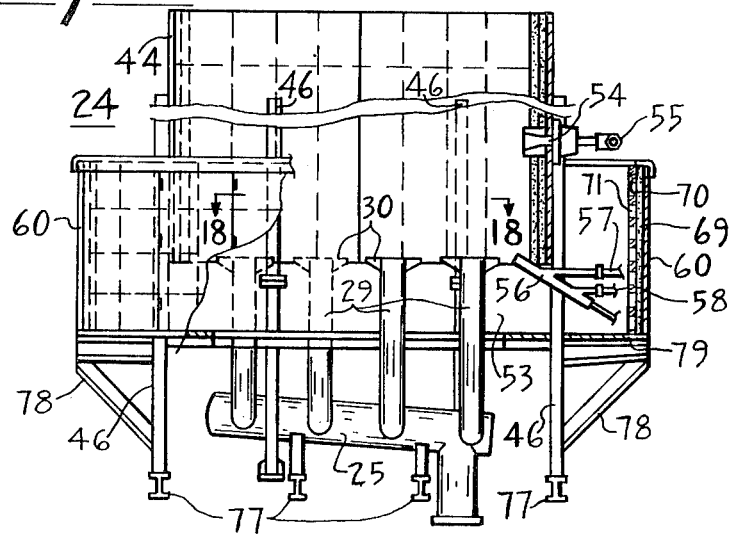
FIG. 16 is a view similar to FIG. 1 in elevation and as seen from one side of another preferred form of flare burner in accordance with the invention for use in an elevated position.

As shown in FIGS. 16 and 17 the flare burner can be elevated by extending the H-beams 46 downwardly and providing additional horizontal framing 75, and also framing 78 to support a floor 76 for the acoustical fence 60.

In place of the floor 26 a floor 80 is provided composed of longitudinally disposed plates 81 inclined downwardly from the center and overlapped and spaced at their meeting margins. The plate 81 can be supported by struts 82 carried on spaced horizontal frame beams 83. The undersides of the plates 81 have strips 84 of fibrous insulating material secured thereto similar to that used for lining the panels 44 and of a thickness of the order of one and one half inches.

The mode of operation will now be pointed out.

Combustible waste gas which may be low b.t.u. content and of relatively low pressure of the order of a few inches of water can be employed, the burner tips 31 shown particularly in FIGS. 9, 10 and 11 being particularly suitable for burning gas at such pressures, is supplied through the pipe 25 and the pipes 29 to the burner tips 31. The combustible gas may also contain small entrained liquid particles to be burned. Difficulty may be encountered with slugs or plugs of liquid.

The burner tips 31 with the attachments 35, **35*a* shown in FIGS. 12 and 13** are better suited for gas having a high btu content.

The waste gas is burned in the combustion chamber 40. If the gravel bottom of FIGS. 1, 2 and 6 is employed the air voids reduce thermal conduction downwardly, provide a substantially uniform temperature at the location of the header 25 with reduction of unequal expansion while the nature of the gravel bottom permits movement of the header 25 and pipes 29.

If the floor of FIGS. 16 and 17 is employed, any rain which falls when the flare burner is out of operation is readily delivered and cannot collect. At the same time, there is adequate insulation at the floor 80 to protect the pipe 25 and the roof or ship deck therebelow.

The delivery of the combustible waste gas through the pipe 25, the pipes 29 and the burner tips 31 is utilized to induce air through the air inlet openings 53 into the combustion chamber 40 to support effective combustion.

If desired, also combustible waste liquid may also be supplied through the burners 54.

Ignition can be effected by the pilots 56.

The combustion chamber 40 by reason of its construction is light in weight, can be installed for less cost than for tile or brick lined combustion chamber, is flexible so that it will not shatter or break in shipping, does not spall when subjected to rain, operates at a lower skin temperature, absorbs lower frequency noise which can produce a throbbing action and also tends to absorb higher frequency noise in the range from 200 to 600 Hz, heats quickly and cools quickly with variation in combustion rate, does not have problems of expansion and contraction, has less mass so requires much shorter time for start up, has less heat conduction through the walls so that the combustion zone is kept hotter and more efficient.

The introduction of air through the air inlet openings 53 is an unavoidable source of noise. The acoustical fence 60 has a multiple function in that it minimizes the effects of wind outside the unit, and at the same time it is effective for noise reduction. The steel shell 68 and glass fiber blanket 69 of the panels 61 is effective for absorption of high frequency noise while the perforated steel plate 70 acts as a Helmholz resonator and absorbs the lower frequency noise.

I claim:

1. A flare gas burner for combustible waste gas comprising a vertical combustion chamber open at the top and spaced upwardly at the bottom for induction of air thereinto for combustion, means for supplying combustible waste gas to the bottom of said combustion chamber through a plurality of burners.

said combustion chamber comprising a plurality of vertical panels each having an outer metallic panel wall and parallel thereto an inwardly facing exposed noise absorbent alumina-silica ceramic fiber blanket of a density of the order of eight pounds per cubic foot having continuous elongated inner and outer faces secured at a plurality of spaced locations to the inner face of said metallic panel wall with said faces parallel to said panel wall.

2. A flare gas burner as defined in claim 1 in which said combustion chamber, spaced above the bottom has burners for supplying combustible liquid waste materials thereinto.

3. A flare gas burner as defined in claim 1 in which an air and wind shielding fence is disposed in surrounding relation to the bottom of said combustion chamber and spaced outwardly therefrom, said fence comprising a plurality of vertical panels each having an outer metallic panel wall, a noise absorbent low density fiber blanket and an inner perforated metallic covering.

4. A flare gas burner as defined in claim 1 in which a fence is provided in surrounding relation to the bottom of said combustion chamber and spaced outwardly therefrom, said fence having sound absorbing characteristics for reducing noise transmission attendant on the entering air and providing a wind shield.

5. A flare gas burner as defined in claim 4 in which said fence comprises a plurality of vertical panels.

6. A flare gas burner as defined in claim 5 in which said panels are readily detachably connected.

7. A flare gas burner for combustible waste gas comprising a vertical combustion chamber open at the top and spaced upwardly at the bottom for induction of air thereinto for combustion, means for supplying combustible waste gas to the bottom of said combustion chamber through a plurality of burners, said combustion chamber comprising a plurality of vertical panels each having an outer metallic panel wall and parallel thereto an inwardly facing exposed noise absorbent low density ceramic fiber blanket secured at a plurality of spaced locations to the inner face of said metallic panel wall, each burner including a plurality of outwardly extending vanes with gas delivery openings.

8. A flare gas burner as defined in claim 7 in which the openings in said vanes are slots.

9. A flare gas burner as defined in claim 8 in which said slots have diverting members disposed outwardly thereof.

10. A flare gas burner as defined in claim 9 in which said diverting members are angles extending along the slots.

11. A flare gas burner for combustible waste gas comprising a vertical combustion chamber open at the top and spaced upwardly at the bottom for induction of air thereinto for combustion, means for supplying combustible waste gas to the bottom of said combustion chamber through a plurality of burners, said combustion chamber comprising a plurality of vertical panels each having an outer metallic panel wall and an inwardly facing exposed noise absorbent low density ceramic fiber covering secured at a plurality of spaced locations to the inner face of said metallic panel wall, said combustion chamber being supported in an elevated condition and having a bottom floor with a plurality of elongated openings therein.

12. A flare gas burner for combustible waste gas comprising a vertical combustion chamber open at the top and spaced upwardly at the bottom for induction of air thereinto for combustion, means for supplying combustible waste gas to the bottom of said combustion chamber through a plurality of burners, said combustion chamber comprising a plurality of vertical panels each having an outer metallic panel wall and an inwardly facing exposed noise absorbent low density ceramic fiber covering secured at a plurality of spaced locations to the inner face of said metallic panel wall, said combustion chamber being supported in an elevated condition and having a bottom floor below said burners, said floor comprising a plurality of spaced overlapping plates with heat insulating material associated therewith.

13. A flare gas burner as defined in claim 12 in which said plates are inclined.

14. A flare gas burner for combustible waste gas comprising a vertical combustion chamber open at the top and spaced upwardly at the bottom for induction of air thereinto for combustion, means for supplying combustible waste gas into the bottom of said combustion chamber through a plurality of burners, an air and wind shielding fence in surrounding relation to the bottom of said combustion chamber and spaced outwardly therefrom for the delivery of air thereover and to the bottom of the combustion chamber.

said fence comprising a plurality of vertical panels each having an outer imperforate metallic panel wall, a noise absorbent low density fiber blanket and an inner perforated metallic covering for reducing outward transmission of combustion noise from the combustion chamber.

15. A flare gas burner for combustible waste gas comprising a vertical combustion chamber open at the top and spaced upwardly at the bottom for induction of air thereinto for combustion, means for supplying combustible waste gas to the bottom of said combustion chamber through a plurality of burners, said combustion chamber comprising a plurality of vertical panels each having a lining of a blanket of ceramic fiber;

said means for supplying combustible waste gas comprising a plurality of outwardly extending vanes with gas delivery openings, and said vanes have pipes extending upwardly therefrom with discharge nozzles thereon.

16. A flare gas burner as defined in claim 15 in which said nozzles are disposed for directing the combustible gas in a vortex pattern.

* * * * *